United States Patent [19]

Niskanen et al.

[11] Patent Number: 4,476,886

[45] Date of Patent: Oct. 16, 1984

[54] AFFIXATION OF A PUMP TO A TANK

[75] Inventors: Toivo Niskanen, Hamina; Raimo Fellman, Heinlahti, both of Finland

[73] Assignee: Kamyr AB, Karlstad, Sweden

[21] Appl. No.: 447,211

[22] Filed: Dec. 6, 1982

[30] Foreign Application Priority Data

Dec. 15, 1981 [FI] Finland ..... 814016

[51] Int. Cl.[3] ..... F04B 23/00

[52] U.S. Cl. ..... 137/15; 137/565; 137/315; 415/219 R

[58] Field of Search ..... 137/565, 315, 15; 222/372, 379, 381, 383; 415/118, 121 R, 201, 219 R; 417/435

[56] References Cited

U.S. PATENT DOCUMENTS

| | | | |
|---|---|---|---|
| 2,103,797 | 12/1937 | Stoddard | 137/565 |
| 2,492,288 | 12/1949 | Hollerith | 137/565 |
| 3,963,046 | 6/1976 | Bergeson | 137/565 |
| 4,221,547 | 9/1980 | Hoffman et al. | 137/565 |

FOREIGN PATENT DOCUMENTS

| | | | |
|---|---|---|---|
| 1131150 | 6/1962 | Fed. Rep. of Germany . | |
| 1484855 | 5/1969 | Fed. Rep. of Germany | 137/565 |

OTHER PUBLICATIONS

Swedish Magazine Advertisement, "Serlachius Pumpum Anatomia on Tutkittu ja Testattu"; 1975.

*Primary Examiner*—Martin P. Schwadron
*Assistant Examiner*—John A. Rivell
*Attorney, Agent, or Firm*—Cushman, Darby and Cushman

[57] ABSTRACT

A method and apparatus allow the simple and effective attachment or detachment of a centrifugal pump to a tank while the tank is filled with a liquid or suspension. The pump rotor is axially movable from a first position where a portion of the rotor is inside the tank, to a second position where no portion of the rotor is inside the tank. With the rotor in the second position, a closing member mounted interiorly of the tank is actuated by an actuator exterior of the tank to effect movement of the closing member to close off a liquid or suspension discharge opening in the tank. The pump housing can then be flushed out, and detached from the tank. During reattachment, the pump housing is filled with fluid under pressure to substantially equalize the pressure on opposite sides of the closing member before the closing member is moved to uncover the tank discharge opening.

20 Claims, 8 Drawing Figures

AFFIXATION OF A PUMP TO A TANK

BACKGROUND AND SUMMARY OF THE INVENTION

The invention relates to a method and apparatus for attaching, and detaching, a centrifugal pump to a tank containing a liquid or suspension, without the necessity of emptying the tank. There are numerous applications in industry wherein a pump is mounted directly to a tank to effect pumping of liquid from the tank. One particular application is the mounting of the centrifugal pump to a bottom portion of a tank containing a cellulosic fiber suspension, preferably of relatively high consistency (i.e. about 8–15%). Typically such pumps are mounted to such tanks—as disclosed in copending application Ser. No. 139,162 filed Apr. 7, 1980; and Canadian Patent No. 1,128,368, the disclosures of each of which are hereby incorporated by reference herein—so that a portion of the pump rotor extends into the interior of the tank through an opening in the bottom of the tank. When it is desired to detach the pump from the tank in such systems it is necessary to drain the tank before detachment. This is an exceptionally tedious, cumbersome, and wasteful practice which it is highly desirable to avoid. According to the method and apparatus of the present invention it is possible to avoid draining of the tank before detachment of the pump, and the pump can be readily detached, repaired or replaced, and reattached.

The basic apparatus features of the present invention are: Means defining a passageway in the bottom of the pump housing, the passageway having a diameter greater than the maximum diameter of the pump rotor (e.g. the impeller blades), and a rotor support member mounting the rotor and axially movable within the passageway. An O-ring, or like sealing means, provide sealing engagement between the pump housing and rotor support member during axial relative movement therebetween. The length of travel of the axial movement is sufficient to move the rotor from its original, first, position wherein a portion thereof extends into the interior of the tank, to a second position wherein no portion of the rotor is within the interior of the tank. A closing means is provided for closing the tank opening after movement of the rotor to its second position, the closing means preferably comprising a closing member mounted for pivotal movement within the interior of the tank, and controlled by an actuator exterior of the tank. The closing member is movable from a first position in which the closing member is arcuately spaced from the opening, to a second position in which the closing member engages a sealing member surrounding the opening, and substantially prevents passage of liquid or suspension from the tank interior through the opening.

When practicing the method of attachment and detachment of a pump to a tank, according to the invention, the rotor is axially moved to its second position, the closing member is moved so that it closes off the opening, and then preferably the interior of the pump housing is flushed with a fluid (e.g. water) to remove fiber suspension, or other materials, therefrom. Then the entire pump housing is detached from the tank. When the pump is to be reattached to the tank, first the pump housing is reattached to the tank with the rotor in its second position, then fluid is supplied to the interior of the pump housing to substantially equalize the pressure on opposite sides of the closing member; then the closing member is pivoted to its arcuate position wherein it does not block the tank opening; and then the rotor is moved axially so that a portion thereof passes through the tank opening into the interior of the tank.

It is the primary object of the present invention to provide a simple and effective method and apparatus for the attachment or detachment of a centrifugal pump to a tank containing a suspension or liquid. This and other objects of the invention will become clear from an inspection of the detailed description of the invention, and from the appended claims.

DETAILED DESCRIPTION OF THE DRAWINGS

Figure 1:
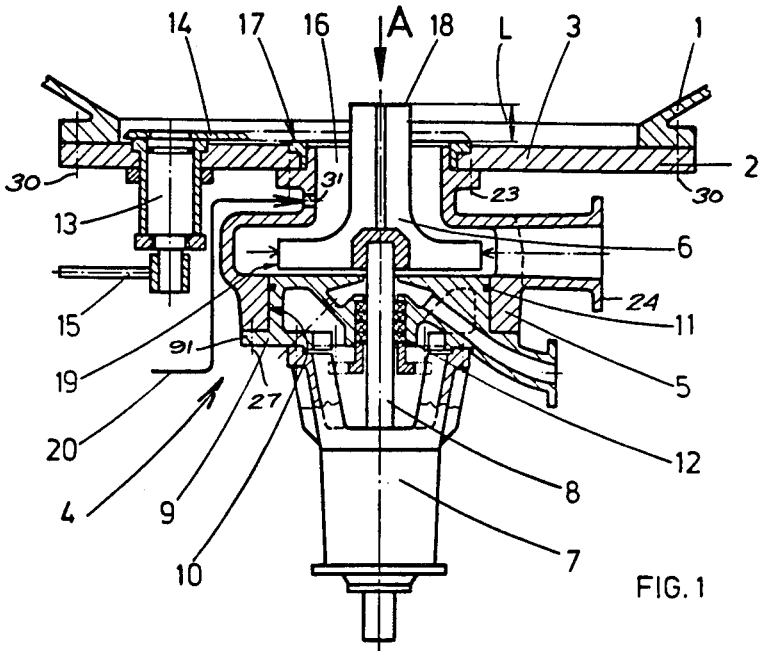
FIG. 1 is a side view, partly in cross-section and partly in elevation, of an exemplary pump and tank system according to the invention.

The basic components of the system illustrated in the drawings comprise a tank 1 and a centrifugal pump 4. The tank includes a flange 2 closing up an opening formed in tank 1. Preferably the flange 2 is disposed at the bottom of the tank 1, and is generally horizontal. In the following description, and in the claims, the relative terms "vertical", "bottom", and "horizontal" will be used for convenience in describing the method and apparatus according to the invention; however it is to be understood that these are relative terms, and the orientation of the components may be different from true "vertical", "bottom", and "horizontal" orientations, as long as the basic objectives according to the present invention are achieved.

The flange 2 includes means defining an opening 16 therein, the opening 16 also comprising the inlet to the pump housing 5. The opening 16 is defined by interior wall portions of the flange 2, and preferably a sealing member 17 is mounted within the opening 16. As illustrated in FIGS. 1, 3, 5, and 7, the sealing member 17 preferably includes a vertically extending portion which is in sealing relationship with the pump housing 5, and a generally horizontally extending portion which is adapted to cooperate with a closing member 14 mounted within the interior of the tank 1. The sealing member 17 may be of any suitable material depending upon the particular application, such as an elastomeric material, a metal, or the like.

Figure 5:
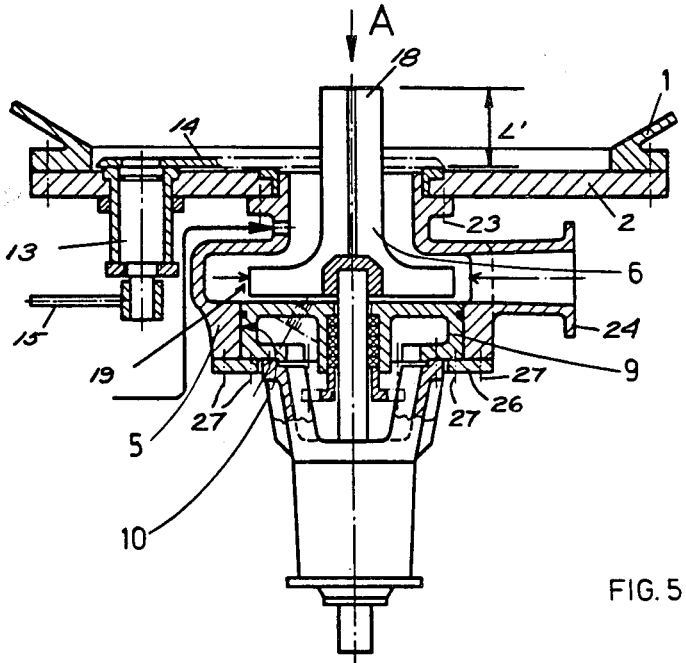
FIGS. 5, 6, 7, and 8 are views identical to those in FIGS. 1, 2, 3, and 4, respectively, illustrating a system having a modified pump design.
Figure 6:
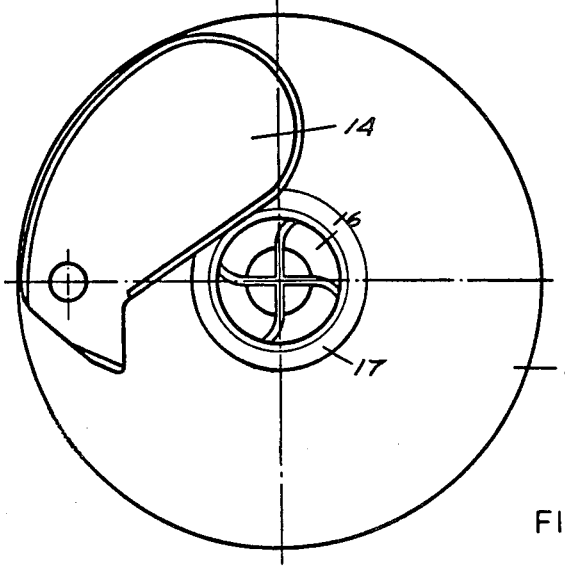
Figure 7:
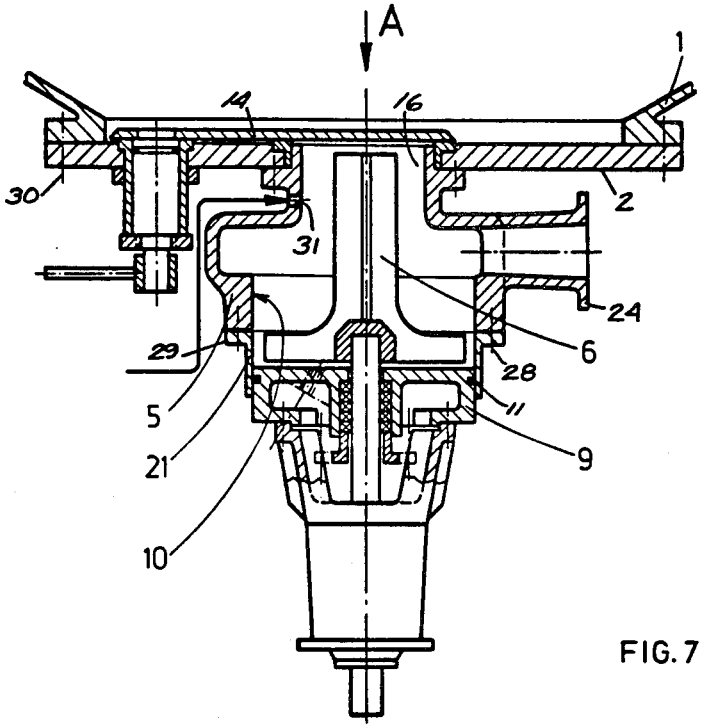
Figure 8:
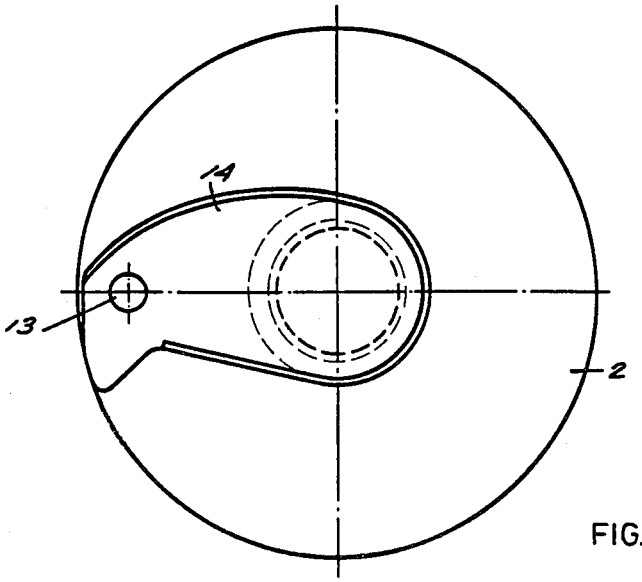

The pump 4 is conventional, and is disclosed more clearly in Canadian Pat. No. 1,128,368 and copending application Ser. No. 139,162 filed Apr. 7, 1980. The pump includes a rotor 6 mounted for rotation by a shaft 8 about a vertical axis, and is journalled in bearing 7. A portion of the rotor 6 extends—in a first position of the rotor as illustrated in FIGS. 1 and 5—into the interior of the tank 1, at least the most axially remote portion 18 of the rotor 6 from the bearing 7 extending into the tank 1. In the FIG. 1 embodiment the rotor 6 extends a length L into the tank interior, while in the FIG. 5 embodiment it extends into the tank interior a distance L'. The pump 4 is adapted to fluidize a fiber suspension within the tank 1, and centrifugally pump the fluidized suspension out the suspension discharge 24.

According to the present invention means are provided defining a passageway 10 in the bottom of the housing 5. The passageway 10 preferably is circular in cross-section, and has cross-sectional dimensions (e.g. diameter) greater than the maximum radial dimension (e.g. diameter) 19 of the rotor 6. A rotor support member 9 has the same cross-sectional dimensions (e.g. exterior diameter) as the passageway 10, and is mounted for linear movement with respect to the passageway 10, guided by the passageway 10. The rotor support member 9 includes bearing components 12 which mount the shaft 8 for rotation therein, the support member 9 being operatively fixed with respect to the bearing 7 and rotor 6, relative rotational movement of the rotor 6 with respect to the support member 9 being possible. The support member 9 also includes a bottom flange portion 9'—which may be annular—thereof, which abuts the bottom of the housing 5 and is adpated to receive screws—shown schematically by reference number 27 in FIG. 1—or like removable fastening means for fixing the housing 5 and member 9 together with the rotor 6 in its first position (FIG. 1). An O-ring 11, or like sealing means is provided to effect sealing between the member 9 and the housing 5 during linear movement therebetween.

Figure 2:
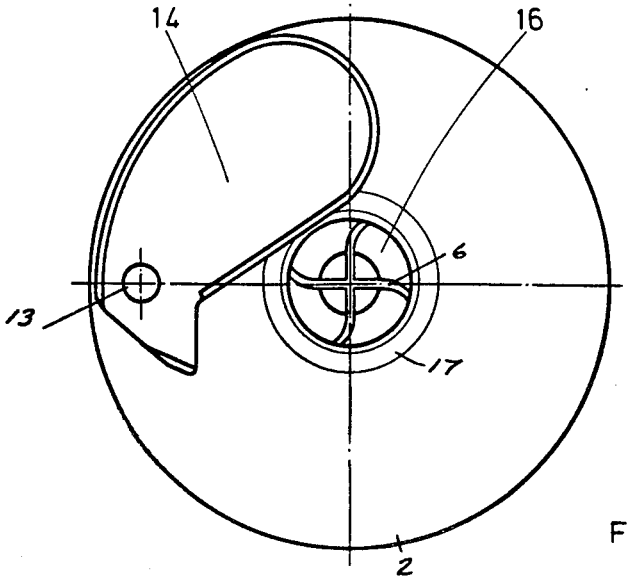
FIG. 2 is a top view of the bottom of the tank of FIG. 1—looking in the direction of arrow A.
Figure 3:
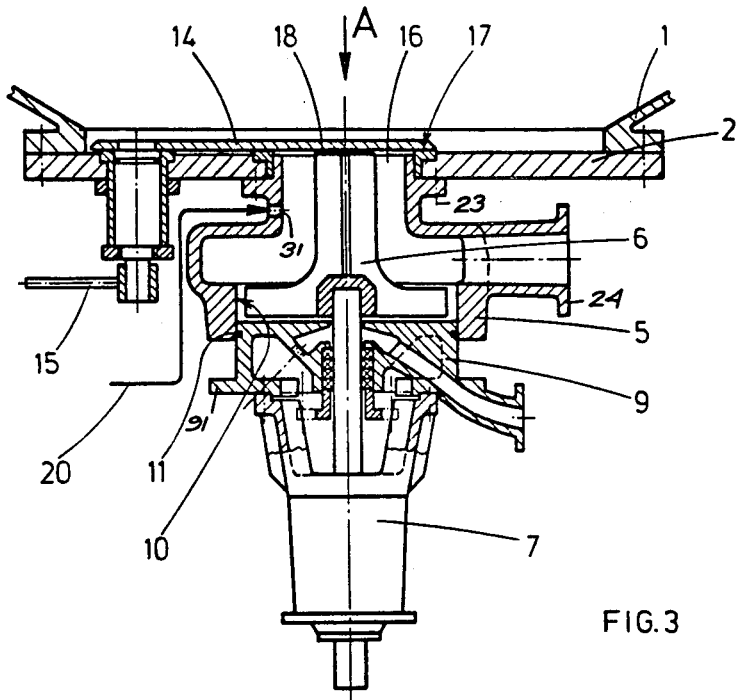
FIG. 3 is a side view identical to that of FIG. 1 except showing the pump rotor moved out of the tank, and a closing member within the tank closing off the opening in the tank bottom.
Figure 4:
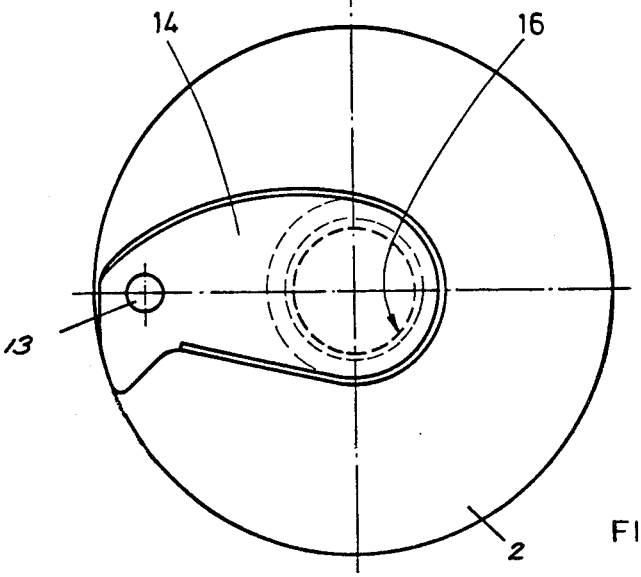
FIG. 4 is a view identical to that of FIG. 2 only with the components in the relative positions illustrated in FIG. 3.

The closing member 14 is part of a means for closing the opening 16 to prevent passage of liquid or suspension from the interior of the tank 1 through the opening 16 once the pump rotor 6 has been moved to its second position (FIG. 3). Preferably the closing member 14 is mounted for pivotal movement by shaft 13 journalled in flange 2, with an actuator 15 exterior of the tank 1 also being attached to the shaft 13 so that pivotal movement of the actuator 15 results in pivotal movement of the closing member 14 between the positions illustrated in FIGS. 2 and 4. In the FIG. 4 position, the closing member 14 engages the generally horizontally extending portions of the annular sealing element 17, to prevent passage of liquid or suspension from the interior of tank 1 through the opening 16. Preferably the flange 2 is also detachably mounted—as by bolts shown schematically by reference numerals 30 in FIG. 1—to the housing 1, to allow replacement, repair, or the like, of the closing member 14 (when the tank 1 is empty).

The embodiment illustrated in FIGS. 5 through 8 differs from the embodiment of FIGS. 1 through 4 only in that the length L' is sufficiently great so that the rotor 6 cannot be completely withdrawn from the housing 1 by axial movement of the support member 9 in the passageway 10 since the support member 9 would go out of sealing relationship with the pump housing 5 before the rotor portion 18 was out of the tank 1, and thus the liquid or suspension from the tank would flow through the pump housing 5 and the passageway 10. In this embodiment, a ring 26 is mounted by bolts 27 to the bottoms of both the housing 5 and the support member 9 when the rotor 6 is in its first position (FIG. 5). Upon detachment of the bolts 27, the ring 26 is removed and is replaced by a tubular guide bushing 21 having an annular flange 29 adapted to abut the bottom of the housing 5 and be held in fixed relationship thereto by the bolts 28 (see FIG. 7). The interior diameter of the guide bushing 21 is the same as the interior diameter of the passageway 10, and provides an extra length of travel of the support member 9 in operative sealing relationship with respect to the pump housing 5 so that the rotor 6 can be moved to its second position (FIG. 7) completely out of the tank 1, and the closing member 14 can be moved to its position (FIGS. 7 and 8) closing off the opening 16.

To facilitate attachment and detachment of the pump 4 from the tank 1, it is also preferable to provide connection means 31 (such as an interiorly threaded passageway receiving an exteriorly threaded bolt or nipple) which allows connection of the pump interior 5 to a pressurized source of fluid (e.g. water) via a conduit 20.

A typical method of detaching a centrifugal pump 4 from a tank 1, according to the present invention, will now be described with respect to FIGS. 1 through 4:

The bolts 27 are removed so that relative movement between the support member 9 and housing 10 is possible, and then an axial force (in the direction of arrow A) is applied to the support member 9 to effect relative linear movement of the support member 9 in the passageway 10 so that the top portion 18 of rotor 6 moves from its first position (FIG. 1) within the tank, to its second position (FIG. 3) out of the tank. Then the actuator 15 is moved arcuately, which effects pivotal movement of the closing member 14 to move it from its FIG. 2 position—wherein it allows free passage of liquid or suspension within the tank 1 through the opening 16—to its FIG. 4 position, wherein the bottom of the closing member 14 cooperates with the horizontally extending portions of the seal 17 to prevent passage of liquid or suspension from the tank 1 through the opening 16. Then (after detachment of housing suspension outlet 24 from its associated conduits), water under pressure is supplied to the interior of the pump housing 5 through line 20 and connection 31, to flush suspension, or any other materials, out of the housing 5. Then the bolts 23 are removed and the entire housing 5 pulled out of operative engagement with the flange 2 and the seal 17.

After repair, replacement, or the like of the pump 4, reattachment of the pump to the tank 1 is effected as follows:

With the rotor 6 in its second position (FIG. 3) the housing 5 is moved into operative engagement with the flange 2 and seal 17, and the bolts 23 are tightened to fasten the housing 5 to the flange 2. With the components in the position illustrated in FIG. 3, and with the suspension discharge outlet 24 blocked off (or connected to appropriate conduits), the pressure on opposite sides of the closing member 14 is essentially equalized by supplying water under pressure through connection 31 to the interior of the housing 5. Once pressure is equalized, actuator 15 is operated to remove the closing member 14 from its FIG. 4 position to its FIG. 2 position. Then the support member 9 is moved upwardly so that top portion 18 of rotor 6 extends into the tank 1, and the ring 16 and bolts 27 are reattached so that the support member 9 is fixed to the housing 5 with the rotor 6 in its first position (FIG. 1).

It will thus be seen that according to the present invention a simple and effective method and apparatus are provided for the attachment and/or detachment of a pump from a tank while the tank contains liquid or suspension. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for mounting a pump to a tank for allowing detachment of the pump from the tank without emptying the tank, comprising:

a pump housing;

a rotor mounted in said pump housing, said rotor mounted for rotation about a generally vertical axis, and said rotor having an axially extending portion thereof, and a radially extending portion thereof having a predetermined maximum diameter;

a tank adapted to contain a liquid or suspension;

means defining an opening in a bottom portion of said tank, said means including a generally horizontally extending flange with interior wall portions of said flange defining said opening;

means for mounting said pump housing to said flange so that said axially extending portion of said pump rotor extends through said opening into the interior of said tank;

means for mounting said rotor for axial movement along said first axis from a first position wherein said axially extending portion of said rotor extends through said opening into the interior of said tank, to a second position, wherein said axially extending portion does not operatively extend into the interior of said tank; said means for mounting said rotor for axial movement comprising means defining a passageway in a bottom portion of said housing, said passageway being generally axially aligned with said opening in said flange, and said passageway having interior cross-sectional dimensions greater than said maximum diameter of said rotor; a rotor support member, including bearing means for mounting said rotor for rotation about said axis, said rotor support member having external cross-sectional dimensions substantially the same as the interior cross-sectional dimensions of said passageway and mounted for sliding movement in said passageway; and sealing means for effecting sealing between rotor support member and said passageway; and closing means for closing said flange opening to substantially prevent passage of liquid or suspension from said tank therethrough when said rotor is in said second axial position, said closing means including a movable closing member mounted in the tank interior, and an actuating member for effecting movement of said closing member, said actuating member operable from exteriorly of said tank.

2. Apparatus as recited in claim 1 wherein said means defining said opening further comprise a sealing member, said sealing member including a generally vertically extending portion for cooperative sealing engagement with said pump housing, and a generally horizontally extending portion for cooperative engagement with said closing member.

3. Apparatus as recited in claim 2 wherein said flange is detachably mounted to said tank.

4. Apparatus as recited in claim 2 wherein said closing means comprise means for pivotally mounting said closing member for pivotal movement in said tank from a first position wherein said closing member is arcuately spaced from said seal, to a second position wherein said closing member engages substantially the entire horizontally extending portion of said seal to effect closing of said opening; and wherein said actuator is operatively connected to said pivotal mounting means for effecting pivotal movement of said closing member.

5. Apparatus as recited in claim 4 wherein said means for pivotally mounting said closing member mounts said closing member to said flange.

6. Apparatus as recited in claim 1 wherein said means for closing said opening further comprises means for pivotally mounting said closing member for pivotal movement from a first arcuate position spaced from said opening, to a second arcuate position closing said opening; and wherein said actuator is operatively connected to said pivotally mounting means for effecting pivotal movement of said closing member.

7. Apparatus as recited in claim 6 wherein said means for pivotally mounting said closing member mounts said closing member to said flange.

8. Apparatus as recited in claim 6 wherein said means for providing axial movement of said rotor comprises flange means formed on the bottom of said rotor support member and cooperating with said pump housing bottom; and removable fastener means for removably fastening said flange means to said pump housing to fixedly mount said rotor support members so that said rotor is in said first position.

9. Apparatus as recited in claim 1 wherein said means for providing axial movement of said rotor comprises flange means formed on the bottom of said rotor support member and cooperating with said pump housing bottom; and removable fastener means for removably fastening said flange means to said pump housing to fixedly mount said rotor support member to said pump housing when said rotor is in said first position.

10. Apparatus as recited in claim 9 wherein said passageway and said rotor support member are circular in cross-section, and wherein said sealing means comprises an O-ring operatively mounted to said rotor support member.

11. Apparatus as recited in claim 6 wherein said means for providing axial movement of said rotor comprise a ring, and means for removably mounting said ring to said bottom portion of said pump housing and to a bottom portion of said rotor support member for fixing said rotor in said first position.

12. Apparatus as recited in claim 11 wherein said means for providing axial movement of said rotor further comprises a guide bushing, said guide bushing having the same cross-sectional dimensions as said passageway, and said guide bushing having an annular flange portion; and removable mounting means for fixing said annular flange portion of said guide bushing to said pump housing bottom portion to allow axial movement of said rotor support member into operative association with the interior of said guide bushing.

13. Apparatus as recited in claim 1 wherein said means for providing axial movement of said rotor comprise a ring, and means for removably mounting said ring to said bottom portion of said pump housing and to a bottom portion of said rotor support member for fixing said rotor in said first position.

14. Apparatus as recited in claim 13 wherein said passageway and said rotor support member are circular in cross-section, and wherein said sealing means comprises an O-ring operatively mounted to said rotor support member.

15. Apparatus as recited in claim 14 wherein said means for providing axial movement of said rotor further comprises a guide bushing, said guide bushing having the same diameter as said passageway, and said guide bushing having an annular flange portion; and removable mounting means for fixing said annular housing bottom portion to allow axial movement of said rotor support member into operative association with the interior of said guide bushing.

16. Apparatus as recited in claim 1 further comprising connection means for operatively connecting said pump housing interior to a source of liquid under pressure so that liquid under pressure can be supplied to said pump housing when said rotor is in said second position thereof and said closing member closes said opening.

17. A method of detaching a centrifugal pump housing from a tank containing a suspension or a liquid, said tank having an opening formed in a generally horizontal portion thereof, and said pump housing including a rotor mounted interiorly thereof for rotation about an axis generally perpendicular to a plane defining said opening, said rotor including a portion thereof extending through the opening into the interior of the tank, comprising the steps sequentially of:

(a) effecting linear movement of the pump rotor along said axis to move the rotor to a position wherein no portion thereof extends into the interior of the tank;

(b) effecting movement of a closing member mounted interiorly of the tank so that it moves to a position closing off the tank opening and substantially prevents passage of liquid or suspension within the tank through the opening, the movement of the closing member being controlled from outside the tank; and (c) detaching the pump housing from the tank.

18. A method as recited in claim 17 comprising the further step (d) of, between steps (b) and (c), supplying a fluid under pressure to the interior of the pump housing to flush material within the housing out of the housing.

19. A method of reattaching a pump housing to a tank containing liquid or suspension, after detachment of the housing as set forth in claim 17, comprising the steps sequentially of:

(i) with the pump rotor moved to a position so that no portion thereof can extend into the interior of the housing, reattaching the pump housing to the tank;

(ii) supplying fluid to the interior of the pump housing to substantially equalize the pressure on opposite sides of the closing member;

(iii) operating the closing member from exteriorly of the tank to move it from a position covering the opening to a position spaced from the opening; and (iv) effecting linear movement of the rotor along said axis so that a portion of the rotor moves through the opening into the interior of the tank.

20. A method as recited in claim 17 wherein step (b) is accomplished by detaching an annular flange from the bottom of the pump housing, the annular flange operatively fixed to the bottom of the pump housing and to a rotor support member axially movable through a circular passageway provided in the pump housing bottom; attaching a guide bushing, having an interior diameter the same as the passageway diameter, to the bottom of the pump housing; and applying a linear force to the rotor support member so that the rotor support member moves along said axis in sealing engagement with said housing bottom portion, and subsequently said guide bushing.

* * * * *